United States Patent [19]

Nitu

[11] 3,951,160

[45] Apr. 20, 1976

[54] BALL UMBRELLA

[76] Inventor: Jon E. Nitu, 155 Logan St., Brooklyn, N.Y. 11208

[22] Filed: Dec. 5, 1974

[21] Appl. No.: 529,795

[52] U.S. Cl. ..... 135/20 B; 2/3 R; 2/84; 2/202; 2/DIG. 3; 9/346; 135/35 S; 135/35 V

[51] Int. Cl.[2] ..... A45B 11/02; A45B 19/02

[58] Field of Search ..... 135/20 B, 35 V, 35 R, 135/35 S, 16, 19.5; 2/DIG. 3, 3 R, 4, 8, 84, 203, 205, 206, 202, 2.1 R; 126/204; 9/331, 332, 346

[56] References Cited

UNITED STATES PATENTS

| | | | |
|---|---|---|---|
| 603,306 | 5/1898 | Weil | 2/4 |
| 1,005,569 | 10/1911 | Demeir | 2/2.1 R |
| 1,204,921 | 11/1916 | Wills | 9/332 |
| 1,205,308 | 11/1916 | Work | 2/8 |
| 1,504,407 | 8/1924 | Williams | 9/346 |
| 1,878,434 | 9/1932 | Belloni | 9/332 |
| 2,372,110 | 3/1945 | Noone | 126/204 |
| 2,978,708 | 4/1961 | Williams et al. | 2/3 R |
| 3,014,221 | 12/1961 | Brunetto | 2/84 |
| 3,320,682 | 5/1967 | Sliman | 126/204 |
| 3,468,299 | 9/1969 | D'Amato | 2/2.1 R |
| 3,802,451 | 4/1974 | Morris | 135/20 B |

FOREIGN PATENTS OR APPLICATIONS

| | | | |
|---|---|---|---|
| 559,613 | 2/1944 | United Kingdom | 9/332 |
| 365,494 | 11/1962 | Switzerland | 135/20 B |

*Primary Examiner*—Werner H. Schroeder
*Assistant Examiner*—Conrad L. Berman

[57] ABSTRACT

A ball type umbrella covering the head and extending below the top of the shoulder line being held in place by a draw string arrangement. The umbrella device is double layered with means of inflation thereof providing optional inflating means at two points within and without the device. The two layers are welded at a multiplicity of points whereby the ball or globular appearance of the umbrella is substantially maintained after inflation and during use due to uniformity of air pressure throughout the interlayer space.

2 Claims, 4 Drawing Figures

BALL UMBRELLA

The invention relates to head coverings and other wearing apparel which are inflated with air or other fluids to preserve the comfort of the wearer in abnormal atmospheres, during inclement weather or the like.

The invention contemplates an air inflated head covering which is particularly adapted for use as a rain umbrella. The umbrella comprises two spaced exterior layers of flexible material both of which are capable of being formed into a globe-like form under sufficient air pressure above an annular line of restriction where a draw string is provided within semi-rigid tubular elements encircling the lower portion of the device. In contrast to the channel means for receiving the inflating fluid in the inflatable hat structure disclosed in U.S. Pat. No. 2,803,015, the double plies used in the present device are spot welded at a plurality of points throughout its extent. On introduction of the air thereinto, it is permitted to flow in all directions for thus maintaining a uniformity of pressure throughout as opposed to intercommunicating, concentric channels as provided in the device disclosed in the aforementioned patent.

One object of the invention is to provide a two ply inflatable umbrella adapted to completely encase the head and shoulders of the wearer and thus serve as an improved means for protecting the user during inclement weather.

Another object of the device is to provide such an inflatable rain protector which maintains a uniformity of air pressure throughout and preserves after inflation the globelike exterior appearance lending distinction without sacrificing the comfort of the user.

Other objects and advantages of the invention may be appreciated on reading the following description of one embodiment thereof which is taken in conjunction with the accompanying drawings, in which:

FIG. 1 discloses the exterior of the ball umbrella as disposed about the head and shoulders of the wearer;

Figure 1:
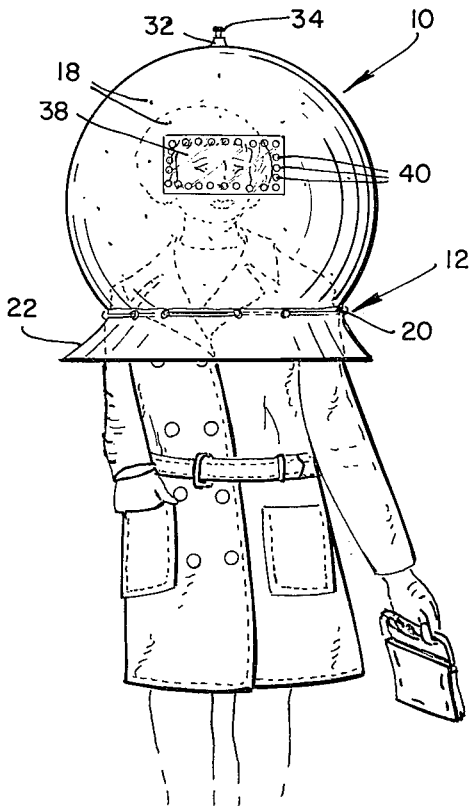
Figure 2:
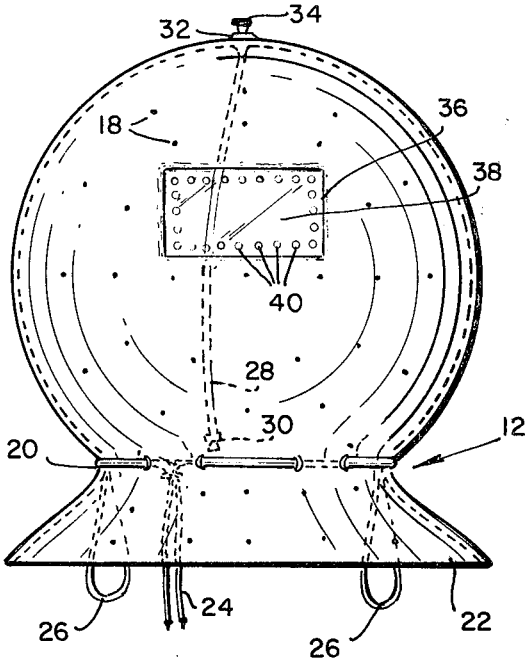
FIG. 2 is an elevational view of the ball umbrella.
Figure 4:
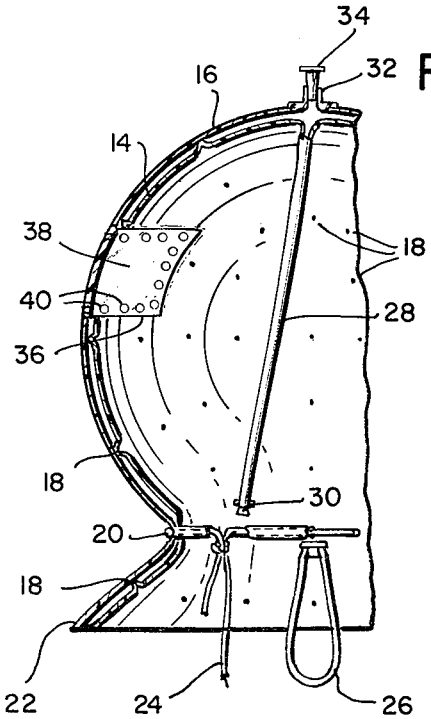
FIG. 4 is a section taken on the line 4—4 of FIG. 3.
Figure 3:
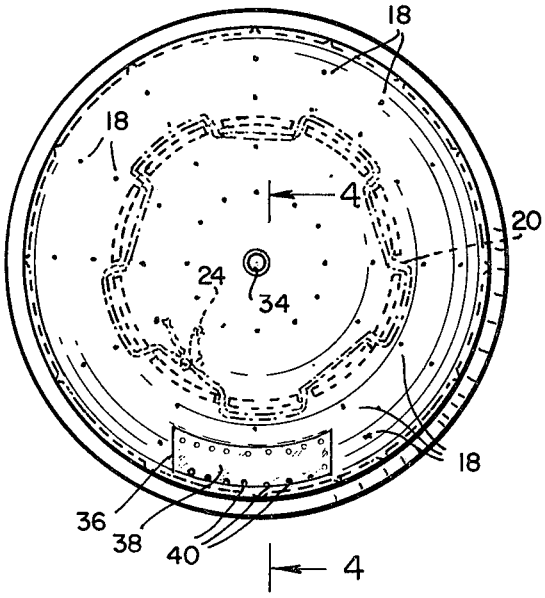
FIG. 3 is a plan view of same.

Referring to the drawings, ball umbrella 10 is formed into its globular shape above draw string line 12. The umbrella is preferably fabricated of a light plastic material such as one of the vinylites by providing sufficient excess of material between constriction line 12 and the top to permit of such formation on inflation.

The entire protector is made in two plies, an inner layer 14 and an outer layer 16, the two plies being spot welded at a multiplicity of points 18.

Weaving in and out of the plies on the line 12 is a sheath 20 which nearly encircles the bottom portion of the device between the umbrella top portion and skirt portion 22. Encased in the sheath is a draw string 24 which is employed to pull the ends of the sheath together after the ball umbrella has been donned so that this portion of the device fits snugly against shoulders of the user. Shoulder straps 26 may also be provided to keep the umbrella positioned during use.

Flexible tube 28 within the ball umbrella is in communication with the air space between the plies and its free end is adapted to be inserted in the mouth of the user for inflating the device as desired. One-way valve 30 is provided in this end for such purpose. An outside valve 32 in similar communication is also provided for inflating the device before placing it over the head, if that is desired. Air stopper 34 is removably disposed in the valve 32 which is used to deflate the umbrella after use.

A rectangular shaped opening 36 is cut in the layers comprising the umbrella top portion which receives a plastic, transparent sheet of material adjacent the eyes of the viewer on donning the umbrella whereby safe viewing without obstruction is provided. Perforations 40 in the side, top and bottom margins of the transparent material 38 provide the desired venting of the ball umbrella for the user.

Various modifications of the invention may be effected by persons skilled in the art without departing from the principle and scope thereof as defined in the appended claims.

What is claimed is:

1. A ball umbrella comprising double, spaced apart layers of a flexible material welded together at random points throughout their extent and, adapted to be inflated into globular form, and worn over the head of the user, the umbrella in such form being open at the bottom and extending to the shoulder region of the user, an internal valve communicating with the space between the layers for producing such inflation, a cord annularly disposed about the umbrella above the bottom edge thereof, the ends of which are adapted to be tied together, an inflatable skirt portion formed between said cord and the bottom edge of the umbrella, said skirt being outwardly flaring after inflation and the tieing together of the ends of said cord with the layers adapted to snugly hug the shoulders of the user, whereby rain water is led away from the body of the user, and a transparent perforated window provided in the umbrella above said cord for venting purposes and to afford outside vision for the user.

2. An umbrella as defined in claim 1 wherein shoulder straps are attached to the layers in the interior thereof at points adjacent the tie cord whereby the security of the device is additionally afforded to the user under severe weather conditions.

* * * * *